United States Patent [19]

Karll

[11] 4,096,708

[45] Jun. 27, 1978

[54] COMPRESSOR REFRIGERATION PLANT

[75] Inventor: Bent Karll, Augustenborg, Denmark

[73] Assignee: Danfoss A/S, Nordborg, Denmark

[21] Appl. No.: 845,119

[22] Filed: Oct. 25, 1977

Related U.S. Application Data

[63] Continuation of Ser. No. 744,631, Nov. 24, 1976, abandoned.

[30] Foreign Application Priority Data

Jun. 22, 1976 Germany ..... 2553562

[51] Int. Cl.[2] ..... F25D 21/06

[52] U.S. Cl. ..... 62/275; 62/81; 62/528

[58] Field of Search ..... 62/275, 81, 199, 200, 62/511, 223, 528, 527

[56] References Cited

U.S. PATENT DOCUMENTS

| | | | |
|---|---|---|---|
| 1,704,177 | 3/1929 | Davenport | 62/511 |
| 2,459,173 | 1/1949 | McCloy | 62/275 X |
| 2,685,780 | 8/1954 | Zearfoss, Jr. | 62/275 |
| 3,638,447 | 2/1972 | Abe | 62/222 |

*Primary Examiner*—William E. Wayner

[57] ABSTRACT

The present invention relates to a compressor refrigeration plant comprising a throttling device between the condenser and evaporator and, associated with the throttling device, an intermittently operable electric heating resistor, a chamber being disposed upstream of at least a part of the throttling device and the electric heating resistor being a PTC resistor which is arranged in the chamber and which, when a temperature range between the evaporating temperature of the refrigerant associated with the pressure in the chamber and the coking temperature of the refrigerant oil is exceeded, goes over from a low to a high resistance.

4 Claims, 1 Drawing Figure

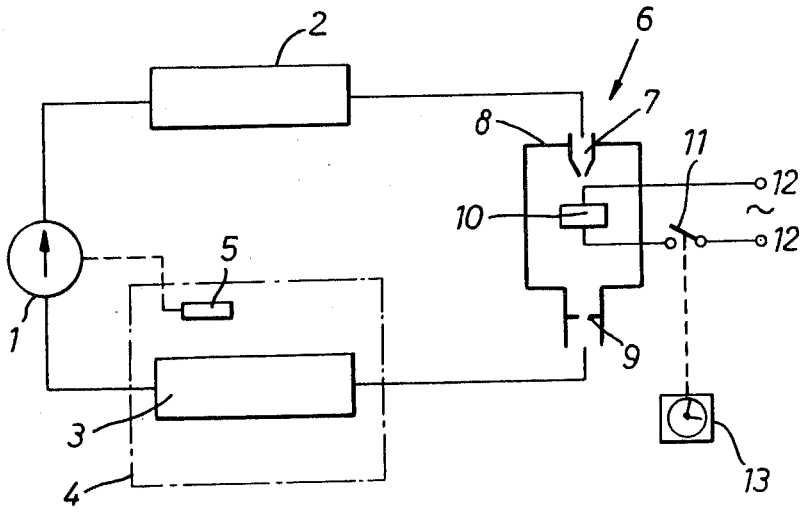
2
6
7
8
11
12
~
12
10
5
1
9
3
4
13

COMPRESSOR REFRIGERATION PLANT

This is a continuation patent application of Ser. No. 744,631 which was filed Nov. 24, 1976, now abandoned.

In the parent patent, the parts of the throttling device consist of capillary tube sections. If, under the same pressure conditions, one passes a liquid refrigerant through one capillary tube section and a refrigerant vapour to the other, the mass of liquid passing through per unit time is substantially three or four times larger than that of the vapour. This already produces a very good blocking effect which can for example be utilised for defrosting.

According to the invention, the consumption of vapour can be reduced still further if the part of the throttling device downstream of the chamber is formed by an axially short throttling element such as a fixed nozzle or diaphragm. With such short throttling elements, the mass of liquid passing through per unit time is six to eight times larger than that of the vapour. Under otherwise identical conditions, therefore, only half the amount of vapour passes through such a throttling element as compared with a capillary tube section that is equivalently designed with respect to the liquid. Consequently, an even better blocking effect is obtained, as a result of which less vapour flows off to the evaporator. Less vapour means less energy, not only with respect to the evaporation by means of the PTC resistor but also for the required subsequent condensation.

If part of the throttling device is also disposed upstream of the chamber, which is not absolutely necessary, this may optionally be a capillary tube section or likewise an axially short throttling element such as a fixed nozzle or diaphragm. The latter is recommendable for the purpose of a uniform construction.

The adopted feature, namely the replacement of at least the downstream capillary tube section by an axially short throttling element, is also applicable to all subsidiary claims of the parent patent.

An example of the invention is diagrammatically illustrated in the drawing. It is the circuit diagram for a compressor refrigeration plant.

In its cycle, the circuit comprises a compressor 1, a condenser 2 and an evaporator 3. The latter is accommodated in a refrigerated space 4. Its temperature is monitored by a thermostat 5 which switches the compressor 1 on and off when required. Between the condenser 2 and evaporator 3 there is a throttling device 6 consisting of a fixed nozzle 7, a chamber 8 and a downstream diaphragm 9. The fixed nozzle 7 and the diaphragm 9 are dimensioned with respect to their throttling resistance so that the liquid refrigerant from the condenser 2 and under the pressure of the condenser reaches the evaporator 3 in an expanded amount designed for normal operation and there evaporates by absorbing heat.

In the chamber 8 there is a heating resistor in the form of a PTC resistor 10 which can be applied to mains terminals 12 by a switch 11. The switch 11 is actuated by a time-clock 13 which initiates a defrosting period of, for example, one hour at predetermined time intervals, e.g. every 72 hours. By means of the PTC resistor, the refrigerant in the chamber 8 is heated so that it evaporates without any coking taking place.

The vapour has a considerably larger volume. Under identical pressure conditions, the mass of refrigerant flowing out of the chamber 8 per unit time is six to eight times smaller than during normal operation. The desired blocking effect is consequently obtained and this is greater than when using a capillary tube section. The vapour is sufficiently hot to melt the frost on the evaporator 3.

For further details, attention is drawn to the parent patent.

I claim:

1. A refrigeration unit having a normal operating cycle and a defrosting cycle, comprising, a compressor, a condenser unit, an evaporator unit, said units being connected in series by conduit means, a chamber in said conduit means between said condenser unit and said evaporator unit, a heating resistor in said chamber, circuit means for supplying a current to said resistor, to produce the defrost cycle by heating the refrigerant to a gaseous state to add heat thereto and slow the flow thereof, throttling means downstream of said chamber formed by an axially short throttling element which only slightly impedes the flow of refrigerant in a liquid state but further slows the flow of a refrigerant in a gaseous state, the portion of said conduit means between said chamber unit and said evaporator unit being a single conduit which carries refrigerant in a liquid state during the normal refrigerating cycle and a reduced quantity of heated refrigerant in the gaseous state during the defrosting cycle.

2. A refrigeration unit according to claim 1 including throttling means upstream of said chamber formed by an axially short throttling element.

3. A refrigeration unit according to claim 2 wherein at least one of said throttling elements is a fixed nozzle.

4. A refrigeration unit according to claim 2 wherein at least one of said throttling elements is an orificed diaphragm.

* * * * *